US009345351B2

(12) United States Patent
Flood et al.

(10) Patent No.: US 9,345,351 B2
(45) Date of Patent: May 24, 2016

(54) LIQUID AND SOLID PACKAGING AND MIXING SYSTEM AND CONTAINER

(71) Applicant: Berlin Packaging, LLC, Chicago, IL (US)

(72) Inventors: Nora Flood, Chicago, IL (US); Liam Hawry, Chicago, IL (US); Brett Niggel, Chicago, IL (US); Scott Jost, Chicago, IL (US)

(73) Assignee: Berlin Packaging, LLC, Chicago, IL (US)

( * ) Notice: Subject to any disclaimer, the term of this patent is extended or adjusted under 35 U.S.C. 154(b) by 0 days.

(21) Appl. No.: 14/847,797

(22) Filed: Sep. 8, 2015

(65) Prior Publication Data

US 2016/0095454 A1 Apr. 7, 2016

Related U.S. Application Data

(60) Provisional application No. 62/060,070, filed on Oct. 6, 2014.

(51) Int. Cl.

| | |
|---|---|
| ***B65D 25/04*** | (2006.01) |
| ***A47G 19/22*** | (2006.01) |
| ***B65D 51/28*** | (2006.01) |
| ***B65D 51/18*** | (2006.01) |

(52) U.S. Cl.

CPC ..... *A47G 19/2272* (2013.01); *B65D 25/04* (2013.01); *B65D 51/18* (2013.01); *B65D 51/28* (2013.01); *B65D 2251/009* (2013.01); *B65D 2251/0028* (2013.01)

(58) Field of Classification Search

CPC ... A47G 19/2272; A61J 1/2093; B65D 51/18; B65D 51/28; B65D 81/3205; B65D 81/3211; B65D 81/3216; B65D 81/3222; B65D 81/3227; B65D 2251/0028; B65D 2251/009; B65D 25/04

USPC ..... 206/219; 215/6, DIG. 8

See application file for complete search history.

(56) References Cited

U.S. PATENT DOCUMENTS

| | | | | |
|---|---|---|---|---|
| 7,484,633 | B1 * | 2/2009 | Moher | A61J 11/04 206/219 |
| 7,896,181 | B1 * | 3/2011 | Francis | A61J 9/008 215/6 |
| 8,083,056 | B1 * | 12/2011 | Wu | B65D 25/08 215/DIG. 8 |
| 2015/0291312 | A1 * | 10/2015 | Kalagher | B65D 81/3227 215/6 |

FOREIGN PATENT DOCUMENTS

| | | | | |
|---|---|---|---|---|
| WO | WO 2006102472 | A1 * | 9/2006 | B65D 81/3227 |

* cited by examiner

*Primary Examiner* — Bryon Gehman

(74) *Attorney, Agent, or Firm* — Adam K. Sacharoff; Much Shelist

(57) ABSTRACT

In one embodiment there is provided a bottle holding a first substance, a tube holding a second substance and a cup holding a third substance. The tube is configured to rest within the bottle and the tube includes an annular flange coving the opening into the bottle. The flange includes a slot to allow the first and second substances to be poured together. The cup is further configured to be secured to the bottle.

6 Claims, 13 Drawing Sheets

LIQUID AND SOLID PACKAGING AND MIXING SYSTEM AND CONTAINER

CROSS REFERENCE TO RELATED APPLICATIONS

The present application claims priority to U.S. Provisional Application 62/060,070 Filed Oct. 6, 2014.

BACKGROUND

The present invention relates to a container that holds different combinations of liquids and solids separate until they are mixed by the end user. While various combinations of bottles are known in the prior art, the invention improves upon the prior art by providing a container that holds various combinations of different liquids and solids separate until mixed.

SUMMARY OF THE INVENTION

In one embodiment of the present invention there is provided a container configured to hold a combination of substances (either liquids and solids) separately in the container until mixed by the end user. The container includes a main bottle configured to hold a first substance and a centered tube configured to hold a second substance and designed to rest within the main bottle. The container also includes a cap securing to main bottle and centered tube together. A top cup configured to hold a third substance is secured to the cap. A cup lid is then used to seal the top cup.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
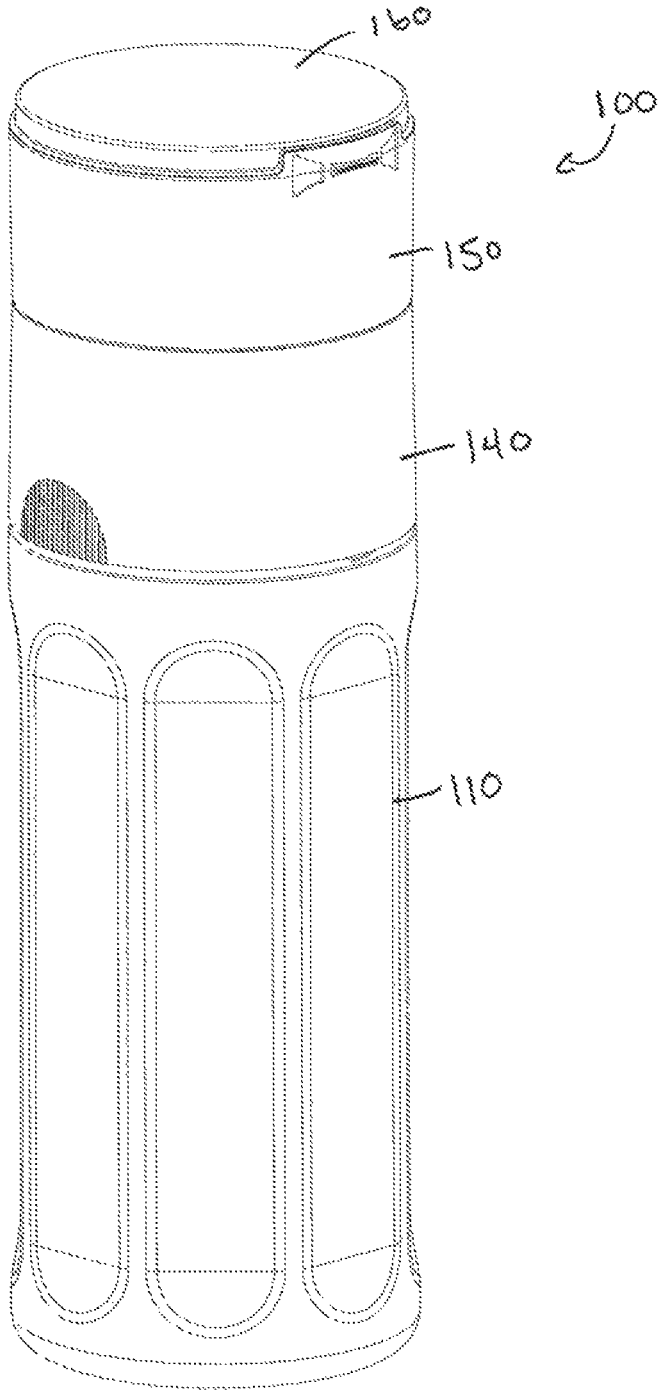
FIG. 1 is a perspective view of a container in accordance with an embodiment of the present invention.
Figure 2:
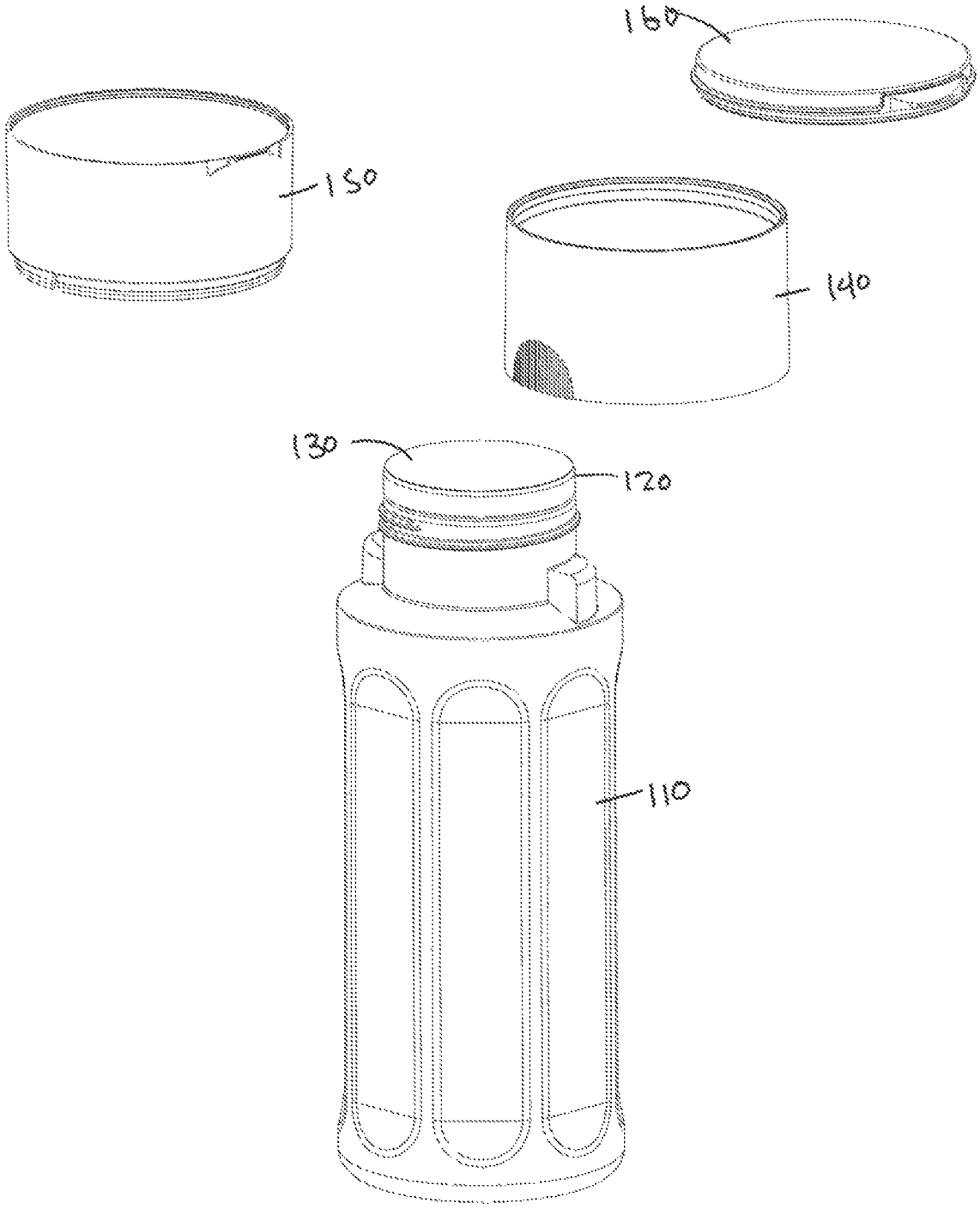
FIG. 2 is part of an exploded perspective view of a container in accordance with an embodiment of the present invention.
Figure 3:
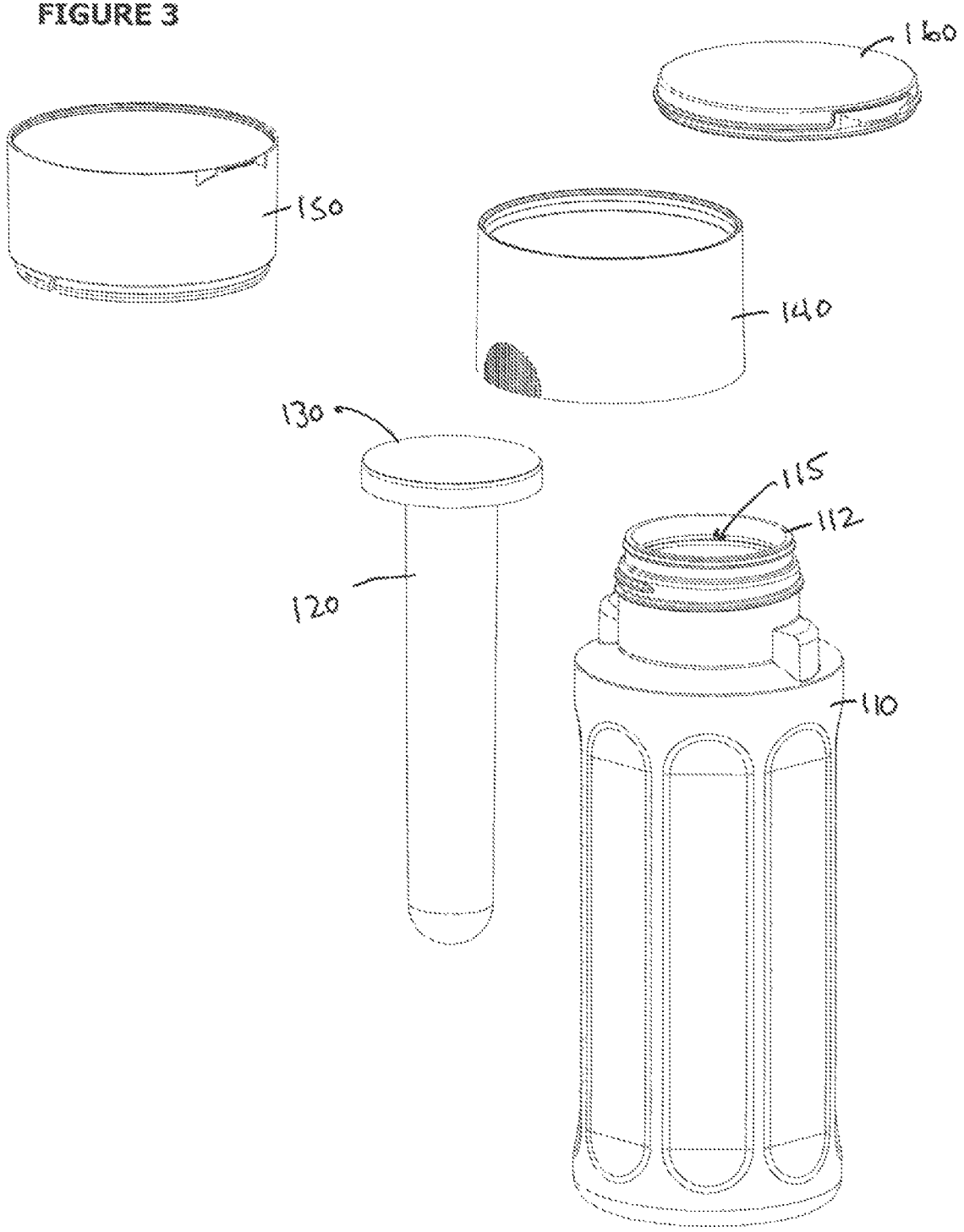
FIG. 3 is part of an exploded perspective view of a container in accordance with an embodiment of the present invention.
Figure 4:
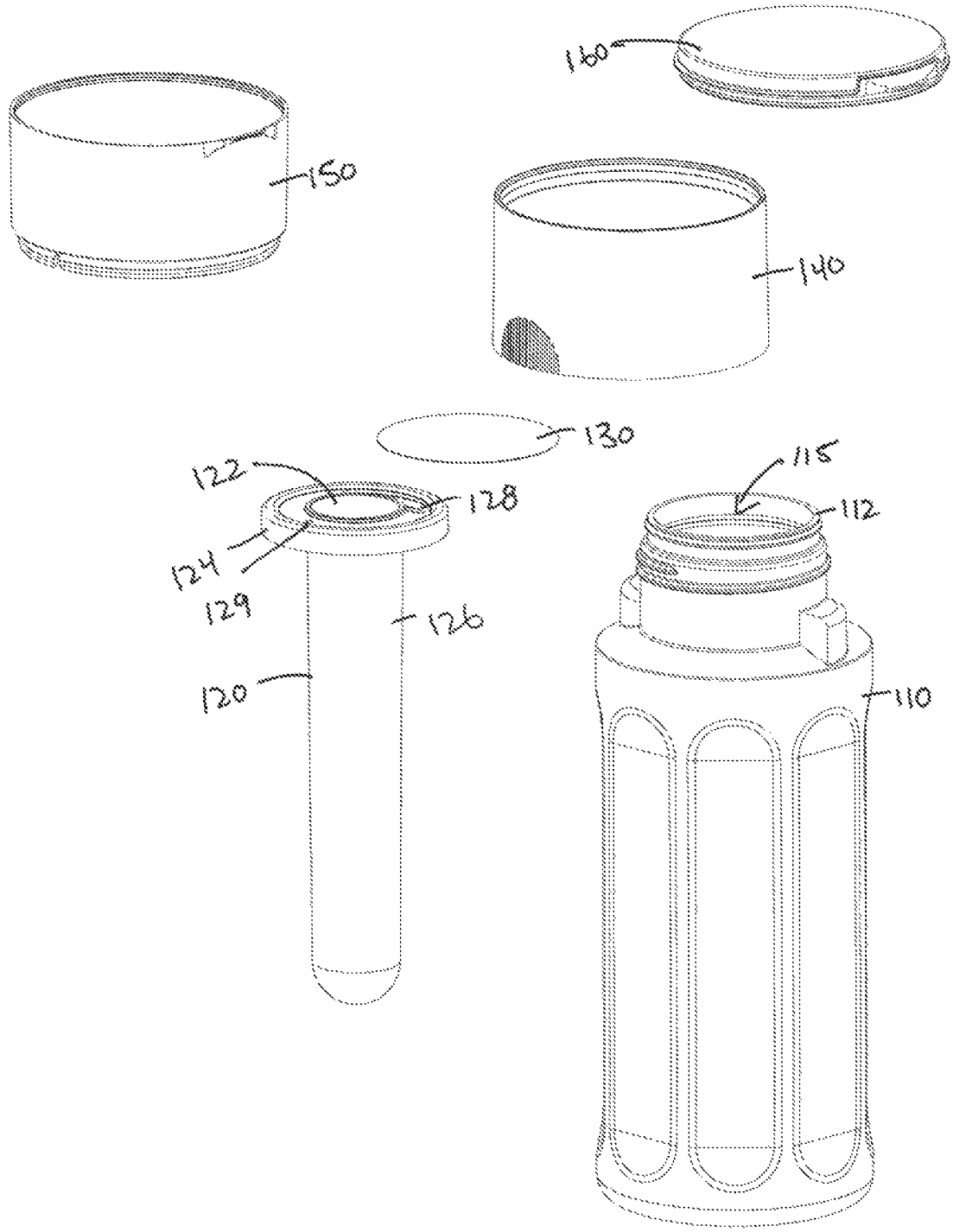
FIG. 4 is part of an exploded perspective view of a container in accordance with an embodiment of the present invention.
Figure 5:
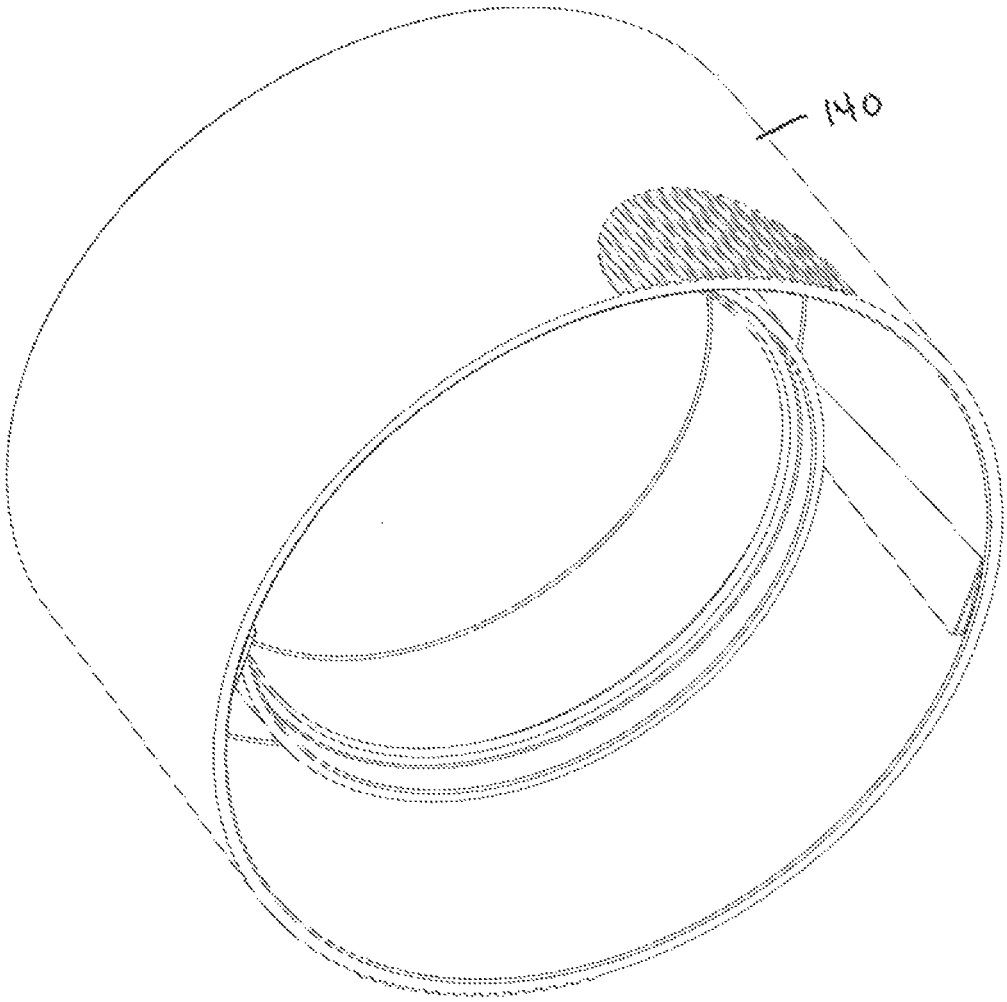
FIG. 5 is a perspective view of a cap for use with a container in accordance with an embodiment of the present invention.
Figure 6:
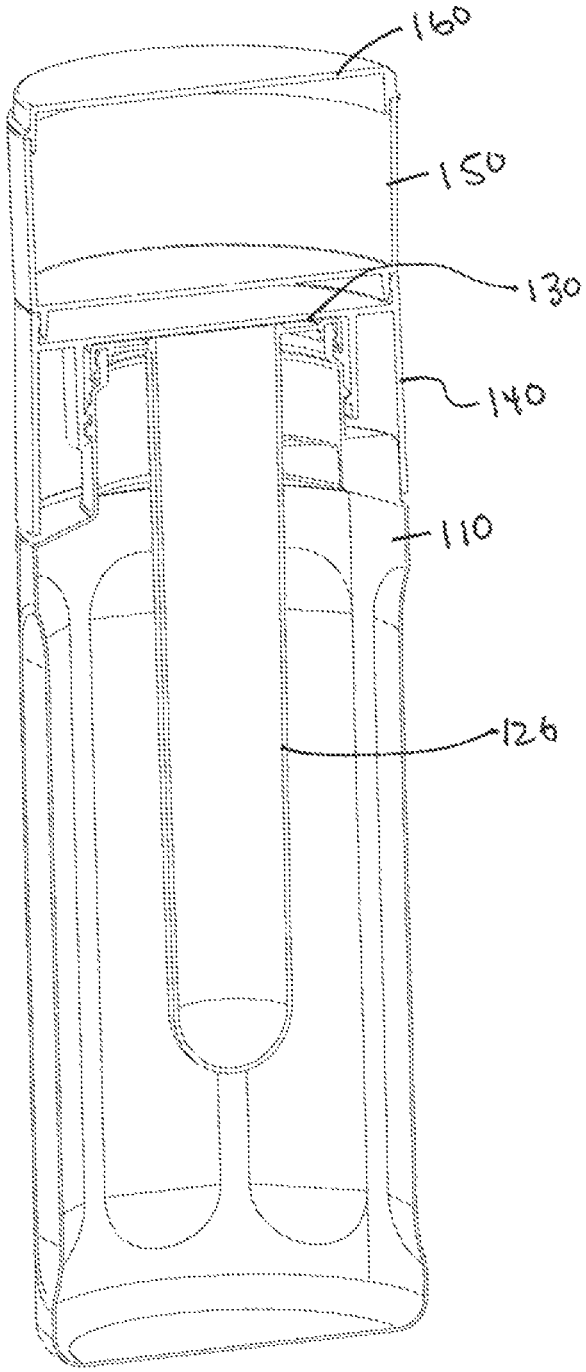
FIG. 6 is a sectional view of a container in accordance with an embodiment of the present invention.
Figure 7:
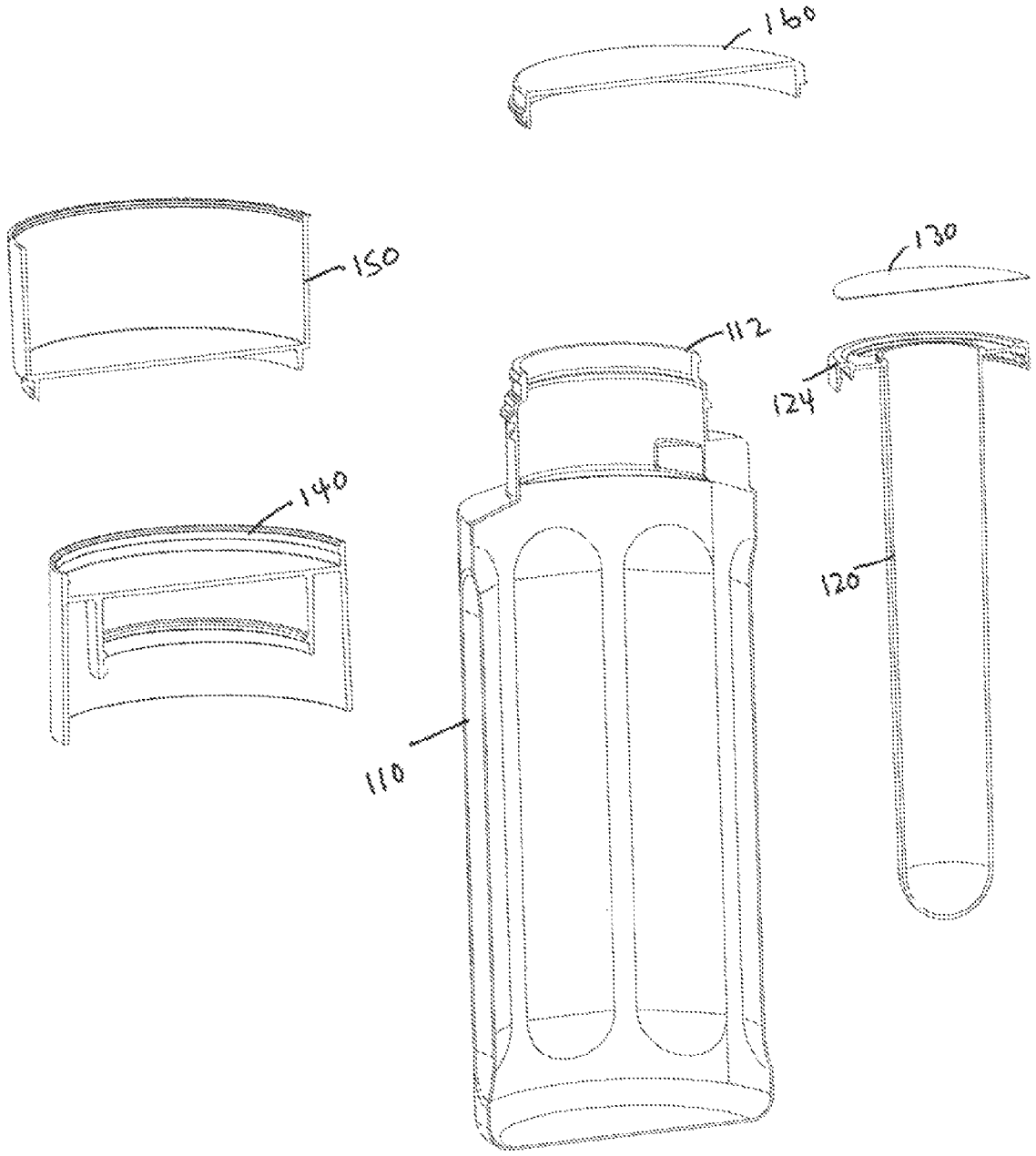
FIG. 7 is part of an exploded perspective sectional view of a container in accordance with an embodiment of the present invention.
Figure 8:
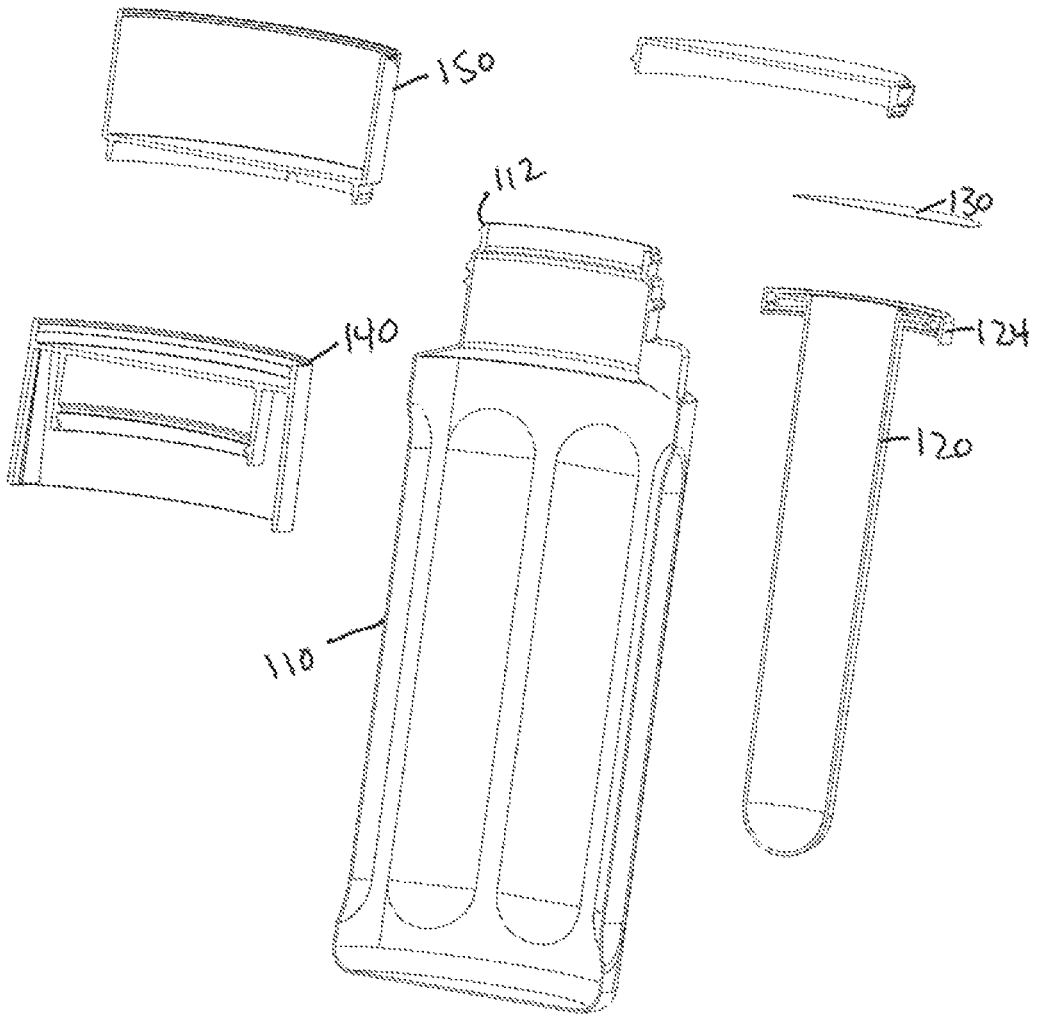
FIG. 8 is part of an exploded perspective sectional view of a container in accordance with an embodiment of the present invention.
Figure 9:
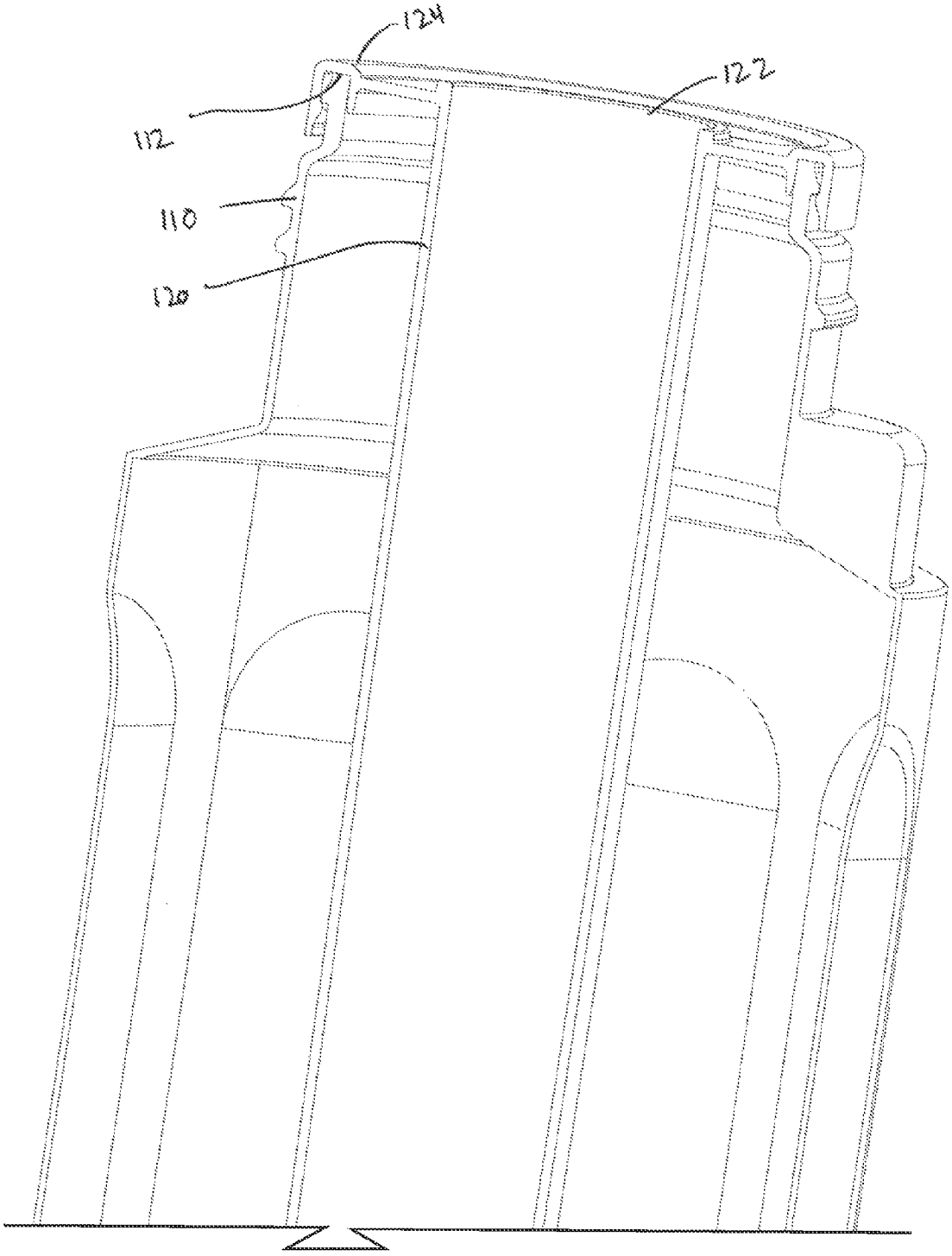
FIG. 9 is a partially enlarged sectional view of components of a container in accordance with an embodiment of the present invention.
Figure 10:
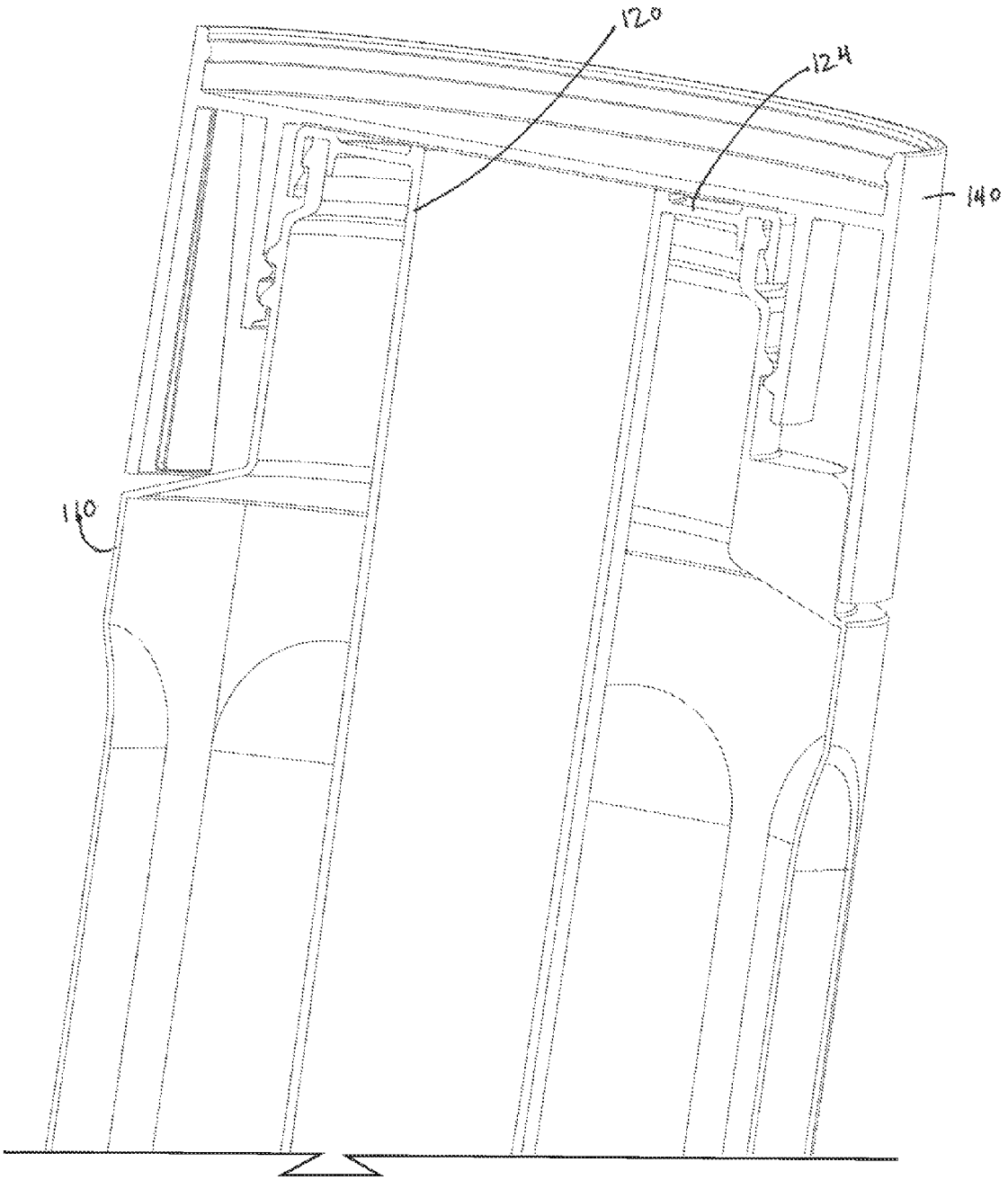
FIG. 10 is another partially enlarged sectional view of components of a container in accordance with an embodiment of the present invention.
Figure 11:
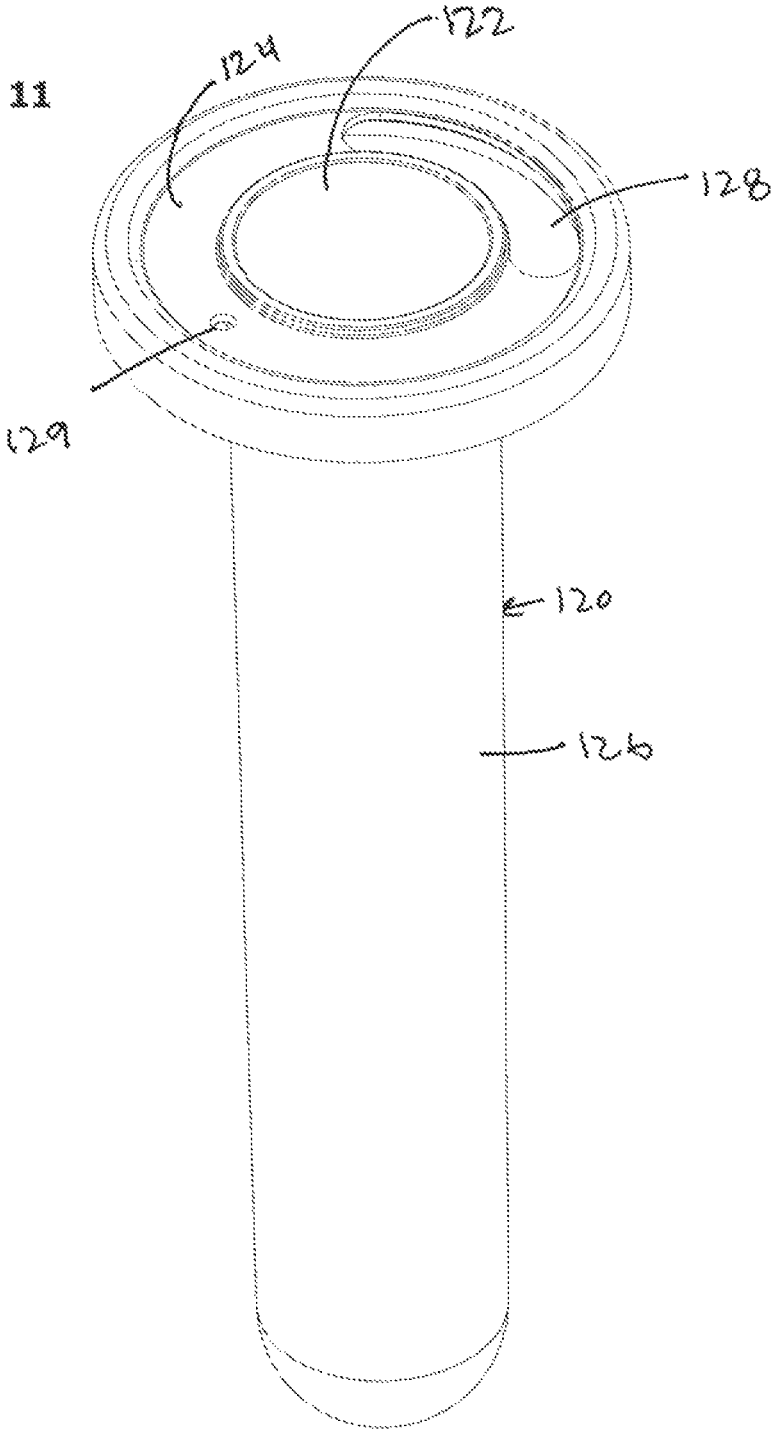
FIG. 11 is a perspective view a tube used in a container in accordance with an embodiment of the present invention.
Figure 12:
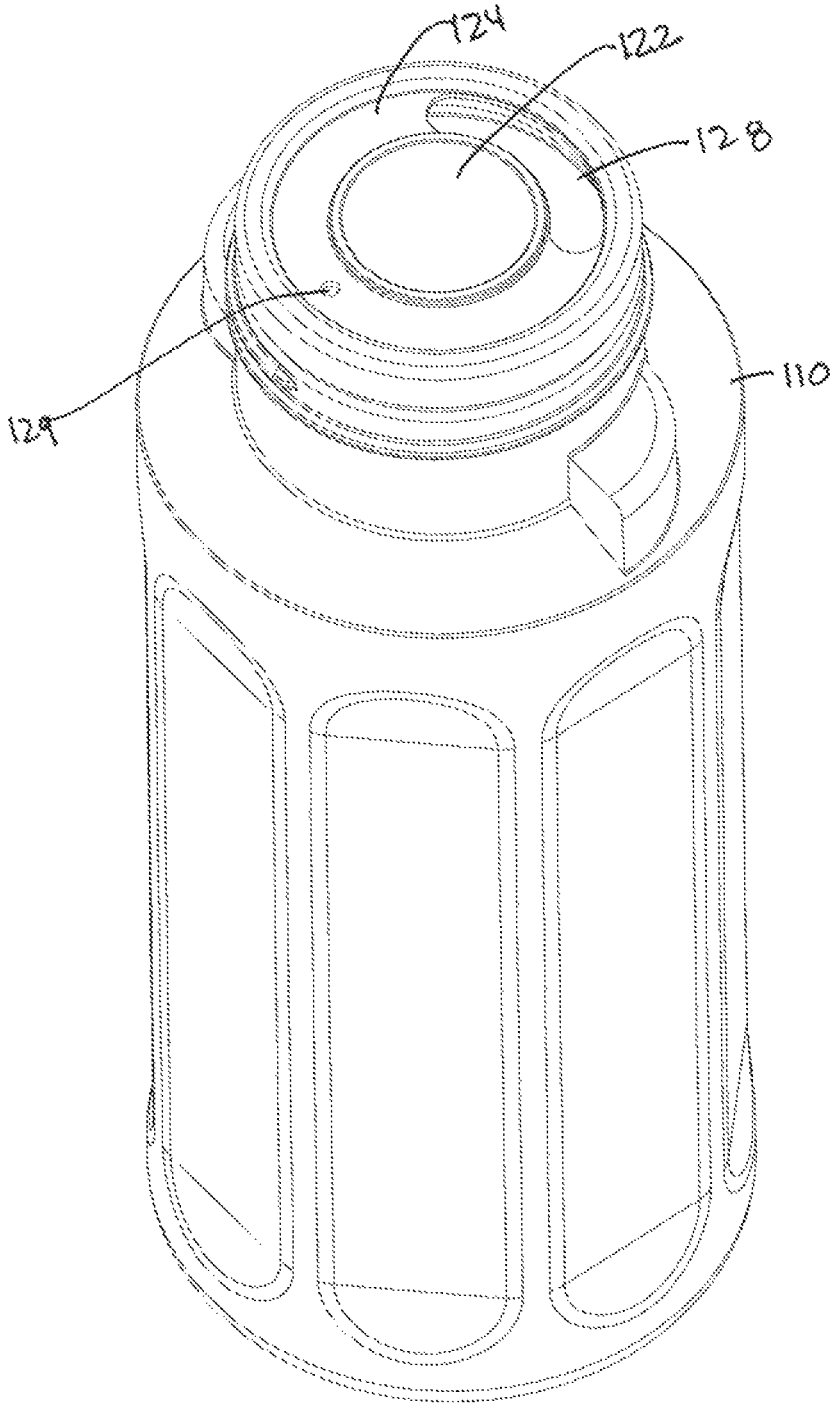
FIG. 12 is a perspective top view of a container in accordance with an embodiment of the present invention.
Figure 13:
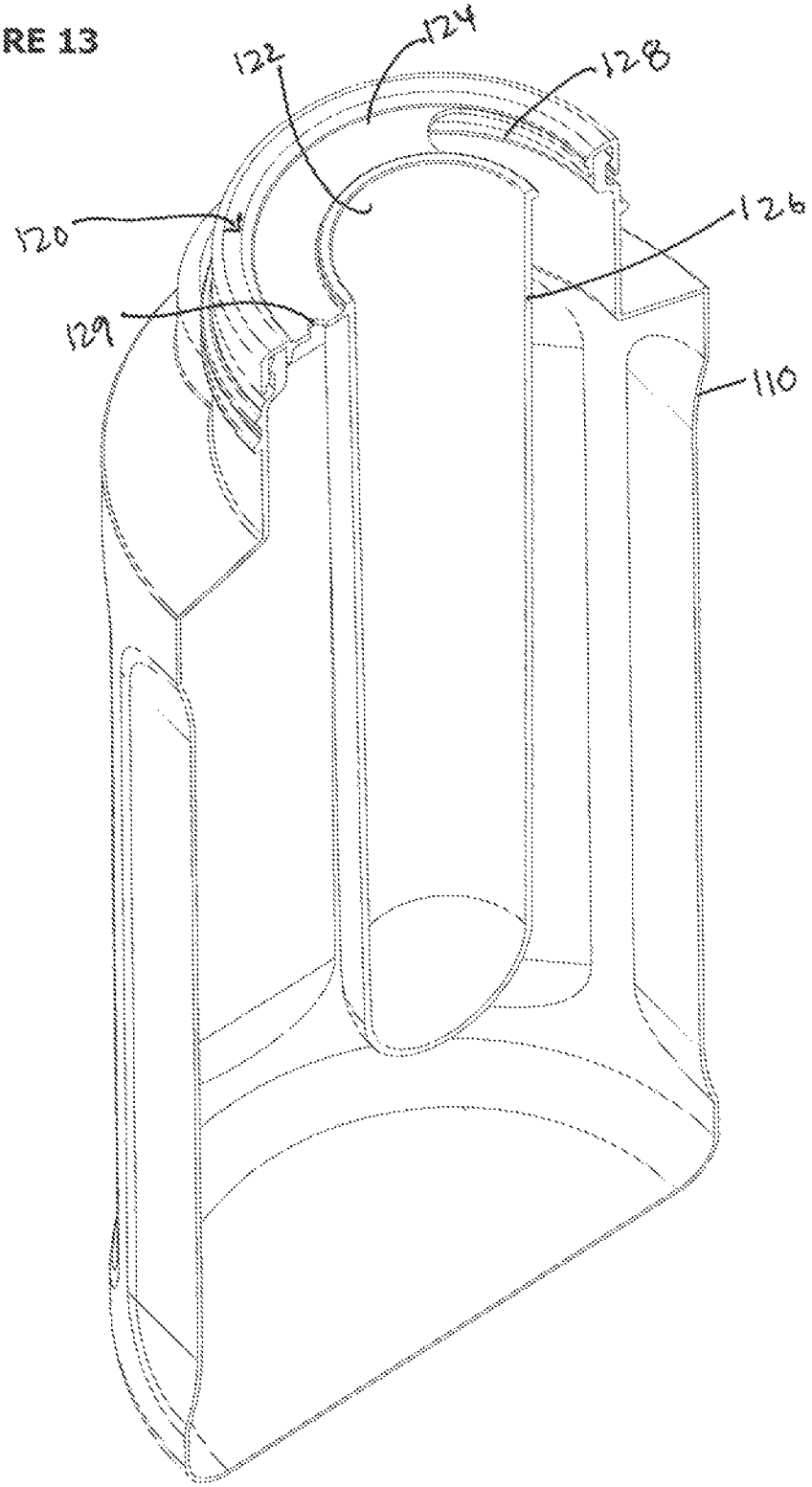
FIG. 13 is a sectional view of a container in accordance with an embodiment of the present invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Referring now to the Figures, there is provided a container 100 configured to hold different substances (either liquids or solids) separately until they are mixed by the end user, The container 100 includes a main bottle 110 configured to hold a first substance. The main bottle 110 includes an annular edge 112 surrounding an opening 115 into the bottle 110. The container 100 includes a tube 120 configured to hold a second substance. The tube 120 includes an opening 122 into the tube 120 and further includes an outwardly extending annular flange 124 that permits the tube 120 to rest on the annular edge 112 with the body 126 of the tube 120 positioned within the bottle 110. The annular flange 124 of the tube 120 further includes an slot or orifice 128 and a vent hole 129 into the opening of the bottle 110. Although the vent hole 129 may or may not be present. As shown in one or more of the embodiments, the body 126 of the tube 120 as a smaller area than the area of the bottle 110 which permits the first substances to be stored around the second substances without interacting. However, when the bottle and tube are tilted the contents of the tube (through the opening 122) and the contents of the bottle (through the slot 125) may exit at the same time. During transit, the tube may be sealed with an induction seal 130 that can simply be peeled away or punctured prior to use. As one can appreciate the single seal 130 will in fact seal or close both the tube and the bottle.

The tube and bottle are further sealed by a cap 140. The cap 140 can lock onto the bottle 110. The user can simply squeeze opposing sides of the cap 140 to unlock the cap from the bottle. This aspect of unlocking the cap from the bottle is well known in the industry.

Secured onto the cap 140 is a cup 150. The cup is configured to hold a third substance. The cup 150 may include a cup lid 160 that can be hinged onto the cup 150 or snap fitted.

During use, the user can remove the cap from the bottle unseal the tube and pour or empty the first and second substances (as noted above). Along therewith, the user can pour or empty the third substance from the cup at the same time. This permits all three substances to be mixed together at the same time rather than individually or permits emptying the first and second substances together and then the third substances later, after the first and second substances have started mixing and possibly reacting.

With the above configuration, the system represents a way to keep some combinations of liquids (L) and solids (S) in the bottle, cup, and tube separate until they are mixed by the end user, Such combination would include LLL, LLS, SSL, SSL, and SSS.

From the foregoing and as mentioned above, it is observed that numerous variations and modifications may be effected without departing from the spirit and scope of the novel concept of the invention. it is to be understood that no limitation with respect to the embodiments illustrated herein is intended or should be inferred. It is intended to cover all such modifications within the scope herein.

We claim:

1. A container comprising:

a bottle having a continuous walled surface surrounding an interior bottle area extending from a top annular ridge to a bottom base, the top annular ridge further defining a top opening into the interior bottle area, the interior bottle area configured to hold a first substance;

a tube having an annular flange extending from a top portion of the tube, the tube having an interior tube area and being configured to extend within the interior area of the bottle, the annular flange of the tube being positioned over the top annular ridge of the bottle and the annular flange having a slot there-through to the interior bottle area, the interior body area configured to hold a second substance; and a cap having a lower portion configured to removably secure onto an exterior portion of the bottle, the cap further having a cup portion extending from the lower portion and being configured to hold a third substance, and the cap further having a lid to secure over the cup portion, whereby the container is configured to separately hold three substances.

2. The container of claim 1, wherein the annular flange of the tube includes a second slot there-through to the interior bottle area.

3. The container of claim 1, wherein the tube further includes a seal positioned over the annular flange and interior tube area.

4. A container comprising:

a bottle having an interior bottle area, a top annular ridge to define a top opening into the interior bottle area and wherein the interior bottle area is configured to hold a first substance;

a tube having an annular flange extending from a top portion of the tube, the tube having an interior tube area that is smaller than the interior bottle area, the annular flange of the tube being positioned over the top annular ridge of the bottle such that the interior tube area is positioned within the interior area of the bottle, and the annular flange having a slot there-through to the interior bottle area, the interior body area configured to hold a second substance; and a cap configured to removably secure onto an exterior portion of the bottle to cover the annular flange of the tube, the cap having a cup portion configured to hold a third substance, and the cap further having a lid to secure over the cup portion, whereby the container is configured to separately hold three substances.

5. The container of claim 4, wherein the annular flange of the tube includes a second slot there-through to the interior bottle area.

6. The container of claim 4, wherein the tube further includes a seal positioned over the annular flange and interior tube area.

* * * * *